US010530092B2

(12) United States Patent
Hata et al.

(10) Patent No.: US 10,530,092 B2
(45) Date of Patent: Jan. 7, 2020

(54) BRANCH CONNECTOR

(71) Applicant: KYOCERA CORPORATION, Kyoto (JP)

(72) Inventors: Tetsuya Hata, Yokohama (JP); Shigeki Ohara, Isehara (JP)

(73) Assignee: KYOCERA CORPORATION, Kyoto (JP)

( * ) Notice: Subject to any disclaimer, the term of this patent is extended or adjusted under 35 U.S.C. 154(b) by 0 days.

(21) Appl. No.: 16/064,431

(22) PCT Filed: Dec. 20, 2016

(86) PCT No.: PCT/JP2016/087974
§ 371 (c)(1),
(2) Date: Jun. 20, 2018

(87) PCT Pub. No.: WO2017/110820
PCT Pub. Date: Jun. 29, 2017

(65) Prior Publication Data

US 2019/0006790 A1 Jan. 3, 2019

(30) Foreign Application Priority Data

Dec. 25, 2015 (JP) ..... 2015-253394

(51) Int. Cl.
*H01R 11/20* (2006.01)
*H01R 13/58* (2006.01)
*H01R 4/2433* (2018.01)

(52) U.S. Cl.
CPC ..... *H01R 13/58* (2013.01); *H01R 4/2433* (2013.01)

(58) Field of Classification Search
CPC ..... H01R 13/58; H01R 4/2433; H01R 4/00
(Continued)

(56) References Cited

U.S. PATENT DOCUMENTS 4,326,767 A * 4/1982 Silbernagel ..... H01R 4/2454 439/392
4,612,423 A * 9/1986 Munroe ..... H01H 1/585 200/16 R (Continued)

FOREIGN PATENT DOCUMENTS

CN 101237093 A 8/2008
JP 60170974 U1 11/1985

(Continued)

OTHER PUBLICATIONS

International Search Report dated Mar. 21, 2017, in corresponding International Application No. PCT/JP2016/087974.

*Primary Examiner* — Abdullah A Riyami
*Assistant Examiner* — Nelson R. Burgos-Guntin
(74) *Attorney, Agent, or Firm* — Duane Morris LLP

(57) ABSTRACT

A branch connector is capable of preventing cable breakage when subjected to vibration or shock. The branch connector (1) includes a pair of split housings capable of opening and closing with respect to each other, a relay contact (40) supported by the split housings and connecting electrically to a cable guided by the split housings in a closed state, and a cable holder, formed in the split housings to hold the cable, including a tight cable holder on the side closer to the relay contact (40) to hold the cable so that movement of the cable in a radial direction is relatively smaller when the split housings are in the closed state and a loose cable holder on the side farther from the relay contact (40) to hold the cable so that movement of the cable in a radial direction is relatively larger when the split housings are in the closed state.

7 Claims, 7 Drawing Sheets

(58) Field of Classification Search
USPC ..... 439/409, 417, 467
See application file for complete search history.

(56) References Cited

U.S. PATENT DOCUMENTS

| | | | | |
|---|---|---|---|---|
| 5,651,691 | A * | 7/1997 | Grumel | H01R 4/2454<br>439/395 |
| 6,837,737 | B2 * | 1/2005 | Baier | H01R 12/616<br>439/402 |
| 8,192,224 | B2 * | 6/2012 | Schmidt | H01R 24/64<br>439/409 |
| 8,512,066 | B2 * | 8/2013 | Lee | H01R 4/2433<br>439/395 |

FOREIGN PATENT DOCUMENTS

| | | | |
|---|---|---|---|
| JP | 63171971 | U1 | 11/1988 |
| JP | 2605275 | Y2 | 4/2000 |
| JP | 3028988 | B2 | 2/2002 |
| JP | 2006114288 | A | 4/2006 |
| JP | 2014116097 | A | 6/2014 |

* cited by examiner

BRANCH CONNECTOR

CROSS-REFERENCE TO RELATED APPLICATION

The present application claims priority to and the benefit of Japanese Patent Application No. 2015-253394 filed Dec. 25, 2015, the entire contents of which are incorporated herein by reference.

TECHNICAL FIELD

The present disclosure relates to a branch connector for connecting an existing cable (electrical wire), which is connected to an electronic device or electrical device, with another cable (electrical wire).

BACKGROUND

The basic configuration of this type of branch connector includes a pair of split housings capable of opening and closing with respect to each other so as to clamp a cable and a relay contact supported by the pair of split housings and configured to connect electrically to a cable guided by the pair of split housings when the pair of split housings are in a closed state.

Broadly speaking, relay contacts come in two types. The first type includes a pressure-contact groove for pressure contacting an existing cable and a pressure-fixing terminal for pressure fixing another cable, for example as in patent literature (PTL) 1. The second type includes a pair of pressure-contact grooves in parallel for pressure contacting an existing cable and another cable, for example as in PTL 2.

Regardless of which type of relay contact a branch connector includes, the cables are typically tightly clamped (with no gap in a radial direction) and held between the pair of split housings to prevent water from coming into contact with the relay contacts or the cables inside the branch connector.

CITATION LIST

Patent Literature

PTL 1: JP3028988B2
PTL 2: JP2605275Y2

SUMMARY

Technical Problem

After careful study, however, we discovered that in a conventional branch connector that tightly clamps and holds cables between a pair of split housings, the cables might break because of a load (a force in the bending direction) applied locally to the cable clamping portion when the branch connector is subjected to vibration or shock. Cable breakage occurs even more easily when, for example, the branch connector is supported by the cables in a suspended state, and a load (a force in the bending direction) is repeatedly applied to the cables near the cable clamping portion over an extended period of time.

The present disclosure is based on an awareness of the above problems and aims to provide a branch connector capable of preventing cable breakage when subjected to vibration or shock.

Solution to Problem

A branch connector of the present disclosure includes a pair of split housings capable of opening and closing with respect to each other; a relay contact supported by the pair of split housings and configured to connect electrically to a cable guided by the pair of split housings when the pair of split housings are in a closed state; and a cable holder formed in the pair of split housings and configured to hold the cable; wherein the cable holder includes a tight cable holder, on a side closer to the relay contact, configured to hold the cable so that movement of the cable in a radial direction is relatively smaller when the pair of split housings are in the closed state and a loose cable holder, on a side farther from the relay contact, configured to hold the cable so that movement of the cable in a radial direction is relatively larger when the pair of split housings are in the closed state.

The loose cable holder may include a pair of inclined faces that are formed on the pair of split housings, are inclined relative to an opening and closing direction of the pair of split housings and relative to an extending direction of the cable, and face each other when the pair of split housings are in the closed state.

The loose cable holder may include a pair of cable holding grooves that cooperatively hold the cable when the pair of inclined faces face each other.

At least one of the cable holding grooves may include a U-shaped groove that is shallower than a diameter of the cable and an inclined connecting groove that connects to the inclined face while increasing in diameter from a peripheral edge of the U-shaped groove.

The tight cable holder may include a plurality of U-shaped grooves formed in each of the split housings at intervals in an extending direction of the cable.

The plurality of U-shaped grooves formed in one of the split housings may be made deeper than a diameter of the cable, and the plurality of U-shaped grooves formed in the other one of the split housings may be made shallower than the diameter of the cable.

The branch connector of the present disclosure may further include an elastic holder that is formed on at least one of the split housings, is positioned at a front end of the loose cable holder, and elastically holds the cable so that an amount of movement of the cable in a radial direction is larger than an amount of movement of the cable in a radial direction in the loose cable holder.

Advantageous Effect

The present disclosure achieves a branch connector capable of preventing cable breakage when subjected to vibration or shock.

DETAILED DESCRIPTION

Figure 1:
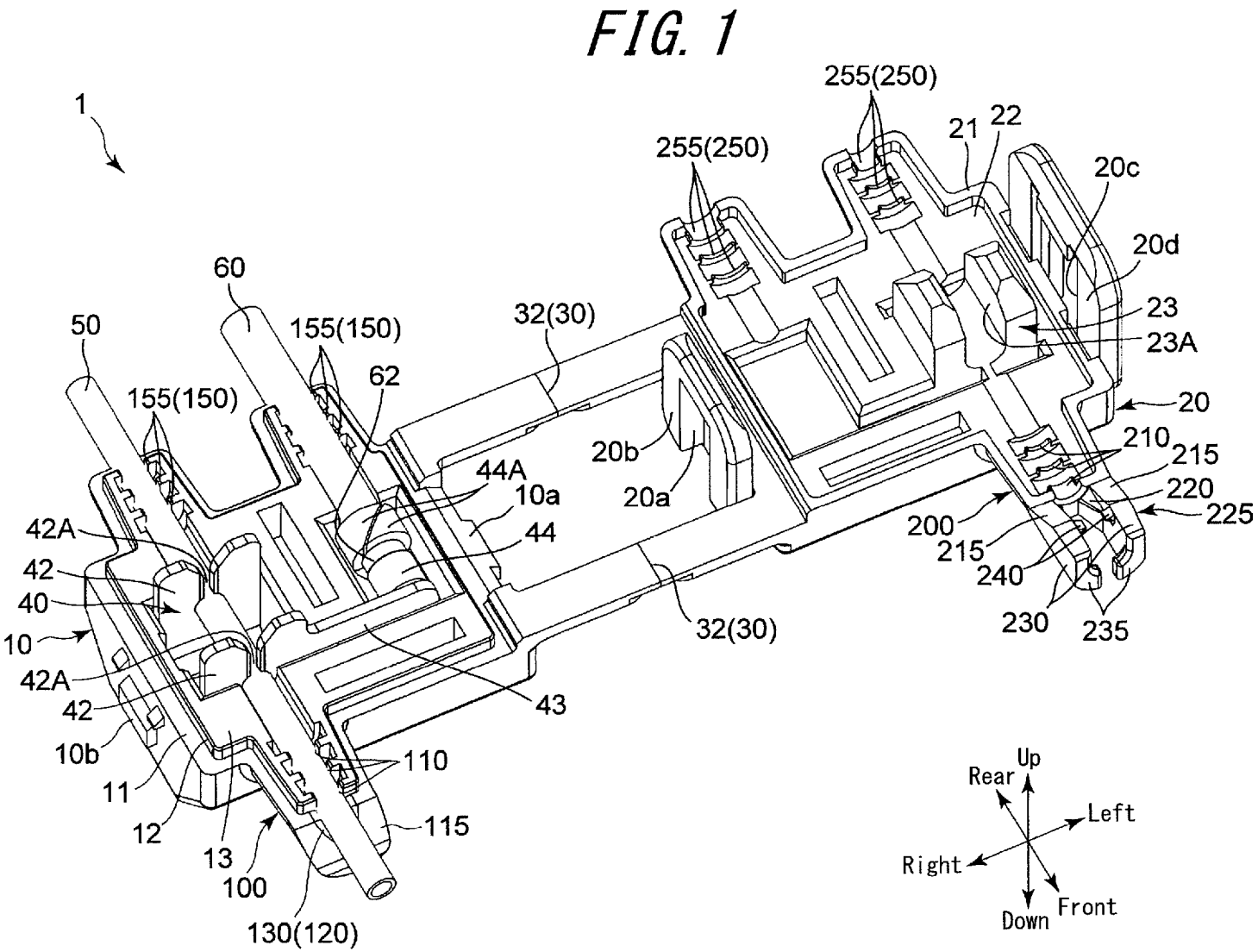
FIG. 1 is a perspective view illustrating the open state of a branch connector of the present embodiment.
Figure 2:
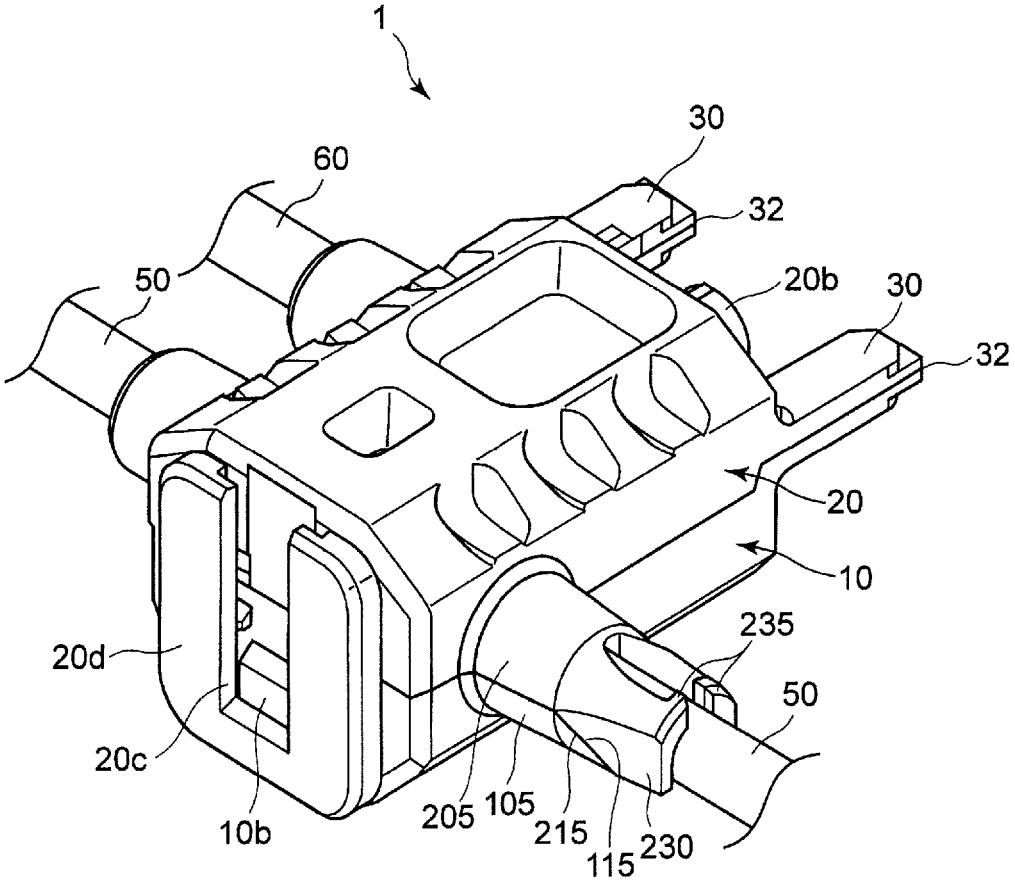
FIG. 2 is a perspective view illustrating the closed state of the branch connector of the present embodiment.
Figure 3:
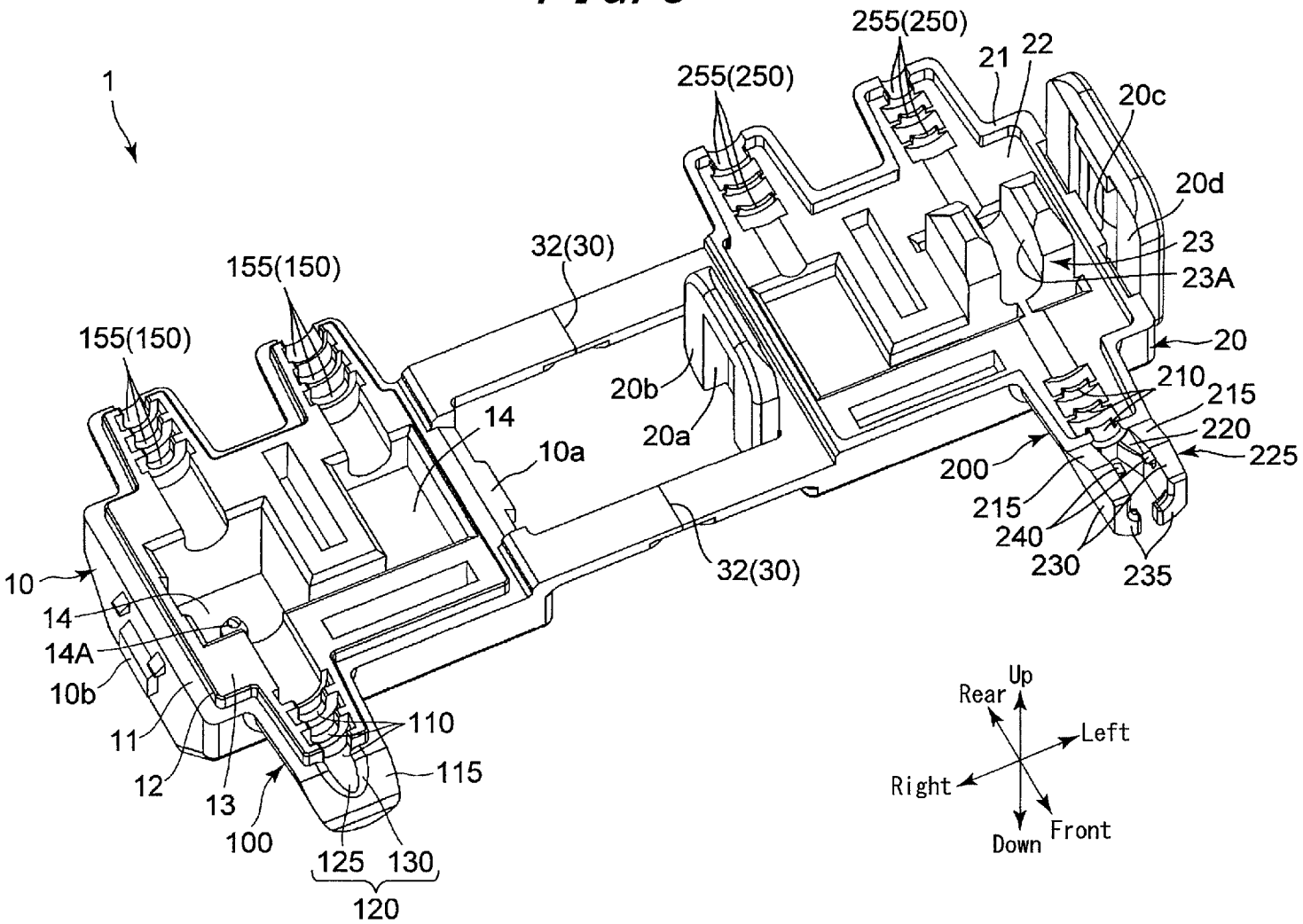
FIG. 3 is a perspective view, corresponding to FIG. 1, illustrating the pair of split housings (first split housing and second split housing) alone.

A branch connector 1 of the present embodiment is described with reference to FIGS. 1 to 7B. The directions in the following explanation (front, rear, up, down, left, and right) are based on the directions of the arrows depicted in the drawings.

The branch connector 1 includes a first split housing 10, a second split housing 20, and a connector 30 for connecting the first split housing 10 and the second split housing 20. The first split housing 10, second split housing 20, and connector 30 are integrally molded articles made from an insulating synthetic resin material. A bending portion 32 is formed in the connector 30. The first split housing 10 and second split housing 20 (pair of split housings) are capable of opening and closing with respect to each other, switching between an "open state" of separation and a "closed state" of contact by the bending portion 32 extending or bending.

A lock piece 10*a* is formed on the left end of the first split housing 10. A lock portion 20*b* having a lock hole 20*a* is formed on the right end of the second split housing 20. Furthermore, a lock piece 10*b* is formed on the right end of the first split housing 10. A lock portion 20*d* having a lock hole 20*c* is formed on the left end of the second split housing 20. The first split housing 10 and the second split housing 20 are locked in the closed state by engaging the lock piece 10*a* with the lock hole 20*a* of the lock portion 20*b* and engaging the lock piece 10*b* with the lock hole 20*c* of the lock portion 20*d*.

An outer peripheral first opposing surface 11 is formed on the outer peripheral edge of the first split housing 10. An outer peripheral second opposing surface 21 is formed on the outer peripheral edge of the second split housing 20. In the closed state (locked state) of the first split housing 10 and the second split housing 20, the outer peripheral first opposing surface 11 and the outer peripheral second opposing surface 21 are in surface contact. This forms the outer peripheral edge of the union of the first split housing 10 and the second split housing 20.

A waterproof wall 12 that rises towards the second split housing 20 is formed on the inner peripheral side of the outer peripheral first opposing surface 11 of the first split housing 10. A containing wall 22 that contains (opposes) the waterproof wall 12 is formed on the inner peripheral side of the outer peripheral second opposing surface 21 of the second split housing 20. In the closed state (locked state) of the first split housing 10 and the second split housing 20, the waterproof wall 12 is contained in the containing wall 22, and the walls oppose each other. A waterproof structure that prevents water from entering inside the first split housing 10 and the second split housing 20 is thus obtained.

A flat portion 13 having substantially the same height as the waterproof wall 12 of the first split housing 10 is formed on the inner peripheral side of the waterproof wall 12. A relay contact attachment recess 14 (FIG. 3) is formed in the central portion of the flat portion 13. A cable pushing projection 23 having a cable pushing groove 23A with a substantially U-shaped cross-section is formed on the inner peripheral side of the containing wall 22 of the second split housing 20.

A relay contact 40 is attached to the relay contact attachment recess 14 of the first split housing 10. The relay contact 40 is molded into the illustrated shape using a copper alloy with spring elasticity (such as phosphor copper, beryllium copper, or titanium copper), or by progressive molding (stamping) of a thin plate of a Corson copper alloy. After forming a foundation of nickel plating on the surface of the relay contact 40, the surface is plated with tin-copper or tin (or gold).

Figure 4:
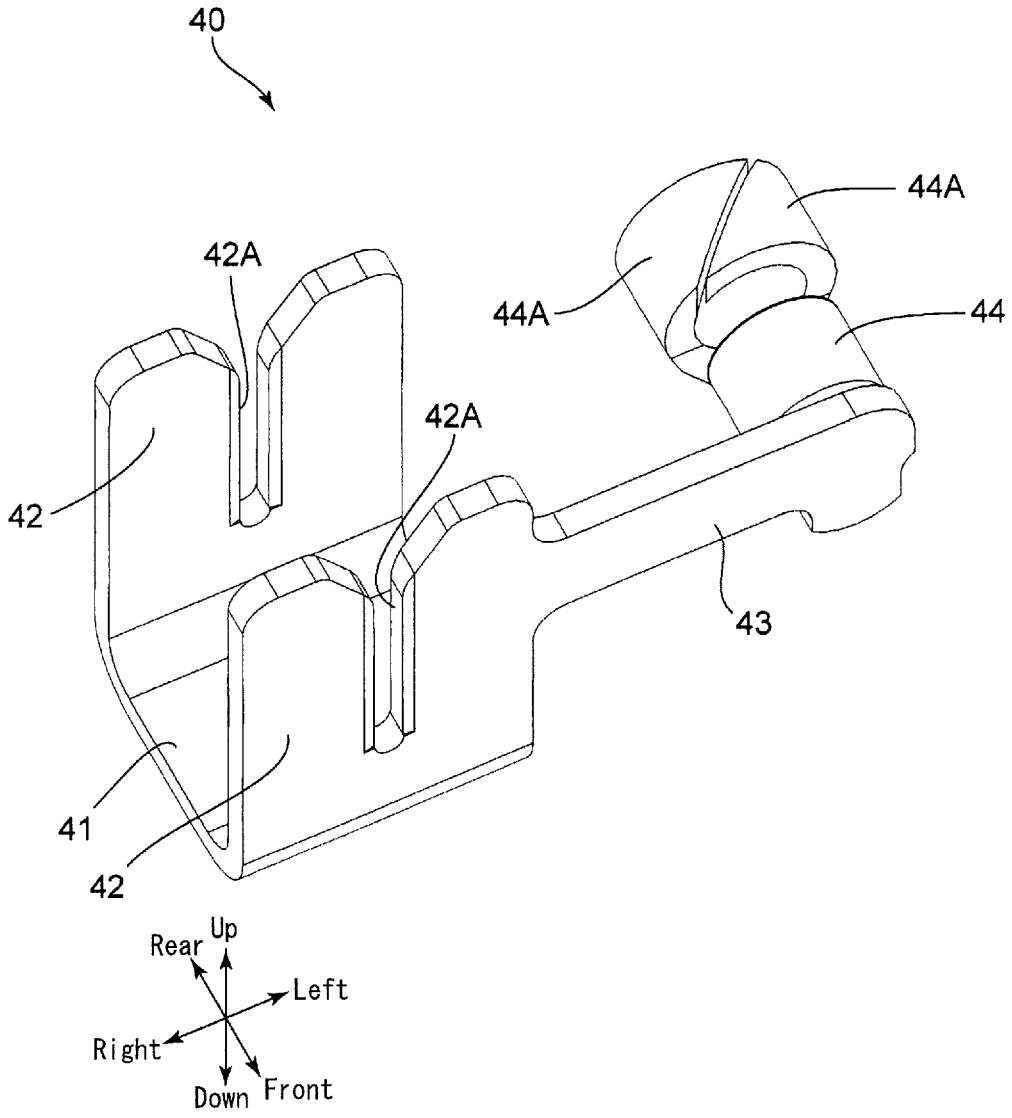
FIG. 4 is a perspective view illustrating a relay contact alone.

As illustrated in FIG. 4, the relay contact 40 includes a bottom wall 41, a pair of cable pressure-contact walls 42 extending from the front and rear ends of the bottom wall 41 in a direction orthogonal to the bottom wall 41, an extension wall 43 extending to the left from the front cable pressure-contact wall 42, and a cable pressure-fixing portion 44 projecting from the rear surface at the left end of the extension wall 43. A cable pressure-contact groove 42A constituted by a slit is formed on each of the cable pressure-contact walls 42. A plurality of cable pressure-fixing pieces 44A is formed on the cable pressure-fixing portion 44. A fixing hole (which is not illustrated and is hidden by the front cable pressure-contact wall 42) is formed on the bottom wall 41 of the relay contact 40. The relay contact 40 is positioned and then fixed in the relay contact attachment recess 14 of the first split housing 10 by a fixing pin 14A (FIG. 3) formed on the relay contact attachment recess 14 of the first split housing 10 being fixed into the fixing hole.

Figure 5:
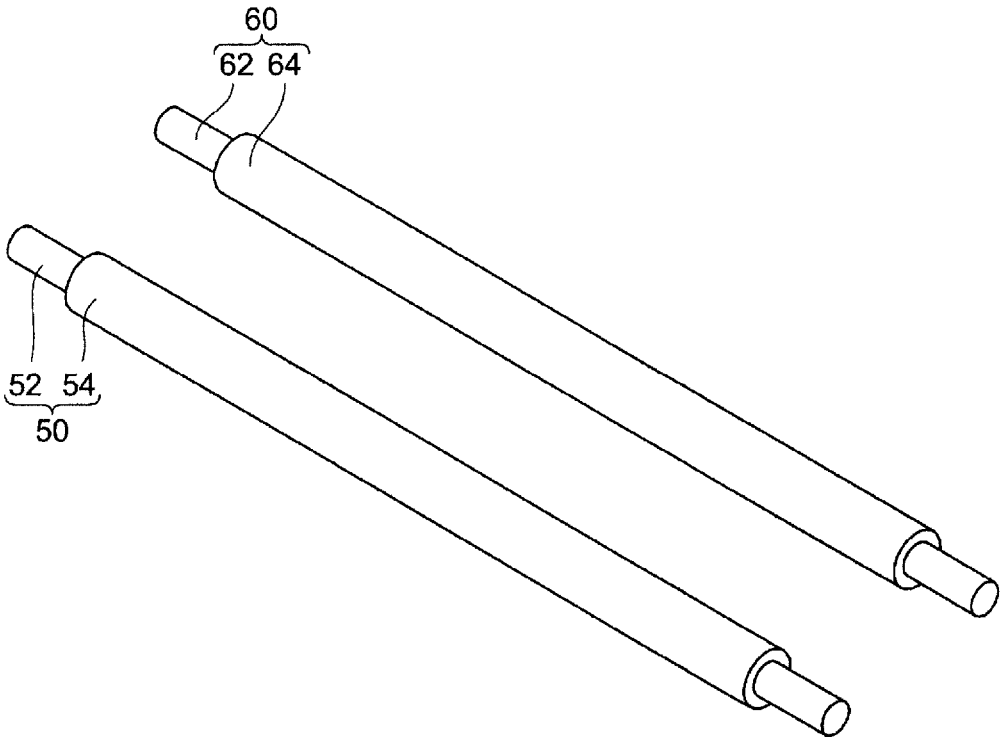
FIG. 5 is a perspective view illustrating the configuration of a first cable and a second cable.

The relay contact 40 is for electrically connecting a first cable 50 and a second cable 60. As illustrated in FIG. 5, the first cable 50 has a core wire (twisted wire or single wire) 52 made of a conductive and flexible material (for example, copper or aluminum), and the surface of the core wire 52 is covered by a tubular covering 54 that is flexible and insulating. Similarly, the second cable 60 has a core wire (twisted wire or single wire) 62 made of a conductive and flexible material (for example, copper or aluminum), and the surface of the core wire 62 is covered by a tubular covering 64 that is flexible and insulating. The first cable 50 is a cable that is laid inside the wiring target (such as an automobile) from the start and is for connecting to a power source of the wiring target. On the other hand, the second cable 60 is additionally connected to the first cable 50 at a later point. An electronic device, electrical device, or the like (such as a car navigation system) is connected to one end (the front end) thereof.

The first split housing 10 and the second split housing 20 have, at the front end thereof, a front cable holder (cable holder) 100 and a front cable holder (cable holder) 200 for cooperatively holding the front portion of the first cable 50.

Figure 6A:
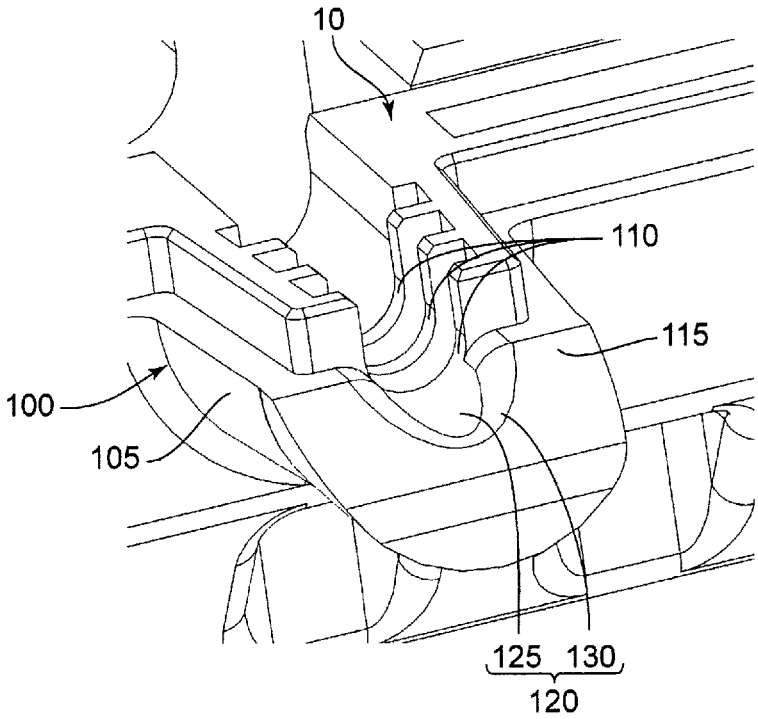
FIG. 6A and FIG. 6B are enlarged perspective views illustrating a front cable holder of the first split housing.
Figure 6B:
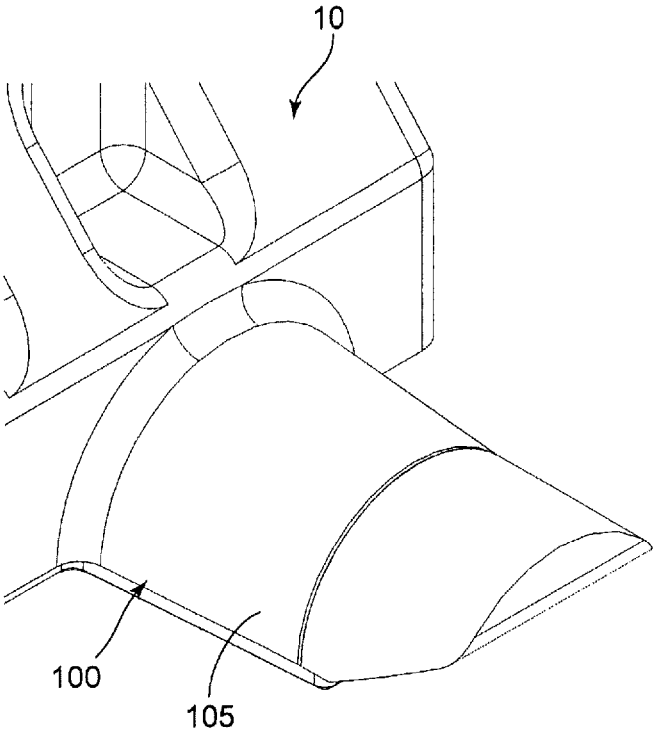

As illustrated in FIG. 6A and FIG. 6B, the front cable holder 100 of the first split housing 10 includes a half cylinder support 105 and a plurality (three in the present embodiment) of U-shaped grooves 110 formed inside the half cylinder support 105 at intervals in the extending direction (front-rear direction) of the first cable 50. The depth of the three U-shaped grooves 110 is set to be greater than the diameter of the first cable 50.

The front cable holder 100 of the first split housing 10 includes an inclined face 115 positioned farther to the front than the half cylinder support 105 and inclined relative to both the opening and closing direction (up-down direction) of the first split housing 10 and the second split housing 20 and the extending direction (front-rear direction) of the first cable 50.

The front cable holder 100 of the first split housing 10 has a cable holding groove 120 communicating from inside the half cylinder support 105 (U-shaped grooves 110) across the inclined face 115. The cable holding groove 120 has a U-shaped groove 125 that is shallower than the diameter of the first cable 50 and an inclined connecting groove 130 that connects to the inclined face 115 while increasing in diameter from the peripheral edge of the U-shaped groove 125.

Figure 7A:
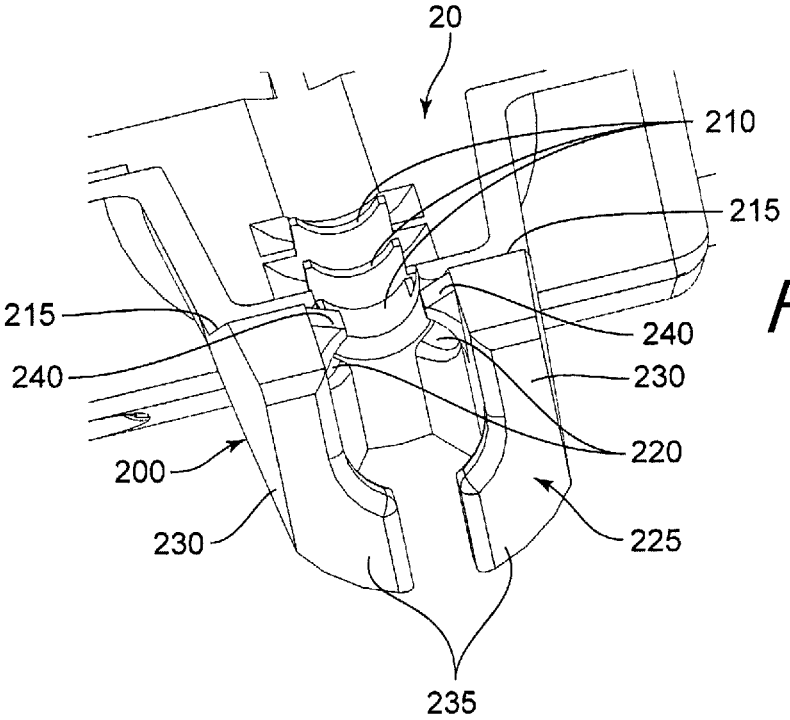
FIG. 7A and FIG. 7B are enlarged perspective views illustrating a front cable holder of the second split housing.
Figure 7B:
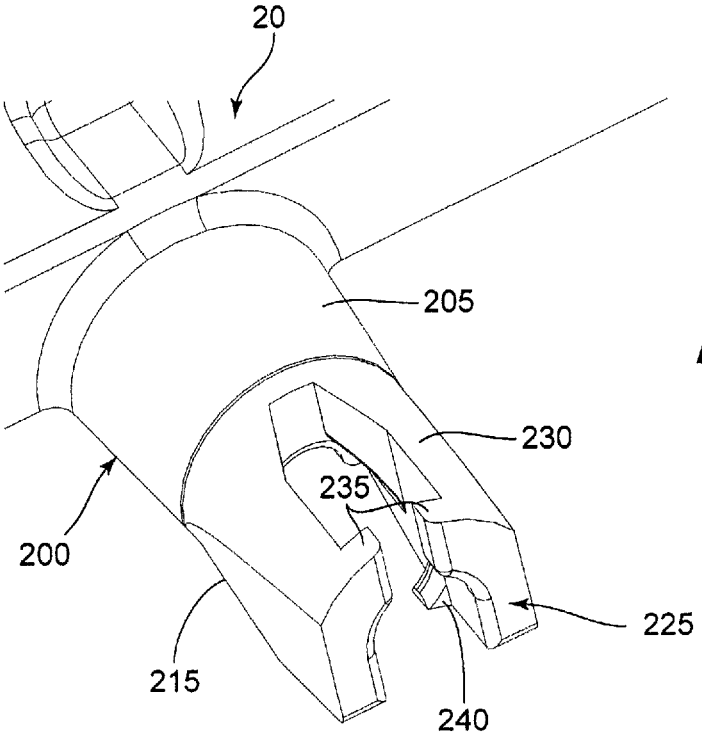

As illustrated in FIG. 7A and FIG. 7B, the front cable holder 200 of the second split housing 20 includes a half cylinder support 205 and a plurality (three in the present embodiment) of U-shaped grooves 210 formed inside the half cylinder support 205 at intervals in the extending direction (front-rear direction) of the first cable 50. The depth of the three U-shaped grooves 210 is set to be less than the diameter of the first cable 50.

The front cable holder 200 of the second split housing 20 includes an inclined face 215 positioned farther to the front than the half cylinder support 205 and inclined relative to both the opening and closing direction (up-down direction) of the first split housing 10 and the second split housing 20 and the extending direction (front-rear direction) of the first cable 50. The inclined face 215 is divided into left and right portions and has a hollowed-out center. A pair of cable holding grooves 220 are formed on the inside of the left and right portions of the inclined face 215.

When the first split housing 10 and the second split housing 20 are in the closed state, the three U-shaped grooves 110 of the front cable holder 100 and the three U-shaped grooves 210 of the front cable holder 200 face each other. Consequently, the first cable 50 is cooperatively held with a relatively small clearance. In other words, movement in a radial direction of the first cable 50 cooperatively held between the three U-shaped grooves 110 of the front cable holder 100 and the three U-shaped grooves 210 of the front cable holder 200 is restricted (the amount of allowable movement in a radial direction is substantially zero).

When the first split housing 10 and the second split housing 20 are in the closed state, the inclined face 115 of the front cable holder 100 and the inclined face 215 of the front cable holder 200 face each other. Similarly, the cable holding groove 120 of the front cable holder 100 and the pair of cable holding grooves 220 of the front cable holder 200 face each other to cooperatively hold the first cable 50 with a relatively large clearance. In other words, the first cable 50 is capable of a slight amount of movement in a radial direction between the inclined face 115 of the front cable holder 100 and the inclined face 215 of the front cable holder 200 using the space of the cable holding groove 120, in particular of the inclined connecting groove 130.

In this way, the three U-shaped grooves 110 of the front cable holder 100 and the three U-shaped grooves 210 of the front cable holder 200 function as a "tight cable holder", on the side closer to the relay contact 40, that holds the first cable 50 so that movement in a radial direction thereof is relatively smaller when the first split housing 10 and the second split housing 20 are in the closed state.

On the other hand, the inclined face 115 and the cable holding groove 120 (U-shaped groove 125, inclined connecting groove 130) of the front cable holder 100, together with the inclined face 215 and the pair of cable holding grooves 220 of the front cable holder 200, function as a "loose cable holder", on the side farther from the relay contact 40, that holds the first cable 50 so that movement in a radial direction thereof is relatively larger when the first split housing 10 and the second split housing 20 are in the closed state.

The front cable holder 200 of the second split housing 20 has an elastic holder 225, positioned farther to the front (towards the front end) from the inclined face 215, that elastically holds the first cable 50 so that the amount of movement of the first cable 50 in a radial direction is larger than the amount of movement of the first cable 50 in a radial direction in the "loose cable holder". This elastic holder 225 has a pair of holding arms 230 extending farther to the front from the left and right portions of the inclined face 215, a pair of cable mounts 235 extending from the lower front end of the pair of holding arms 230 to approach each other in the left-right direction, and a pair of elastic retaining projections 240 extending from the upper portion of the inclined face 215 side of the pair of holding arms 230 to approach each other in the left-right direction. The first cable 50 held between the pair of cable mounts 235 and the pair of elastic retaining projections 240 is capable of slight movement in a radial direction using the space between the cable mounts 235 and elastic retaining projections 240. This amount of allowable movement is greater than the amount of movement of the first cable 50 in a radial direction in the "loose cable holder".

The first split housing 10 and the second split housing 20 have, at the rear end thereof, a pair of rear cable holders 150 and a pair of rear cable holders 250 for cooperatively holding the rear portion of the first cable 50 and the rear portion of the second cable 60.

The rear cable holders 150 of the first split housing 10 each have a plurality (three in the present embodiment) of U-shaped grooves 155 formed inside the half cylinder support at intervals in the extending direction (front-rear direction) of the first cable 50 and the second cable 60. The depth of the three U-shaped grooves 155 is set to be greater than the diameter of the first cable 50 and the second cable 60.

The rear cable holders 250 of the second split housing 20 each have a plurality (three in the present embodiment) of U-shaped grooves 255 formed inside the half cylinder support at intervals in the extending direction (front-rear direction) of the first cable 50 and the second cable 60. The depth of the three U-shaped grooves 255 is set to be less than the diameter of the first cable 50 and the second cable 60.

The branch connector 1 is, for example, assembled as follows.

First, the relay contact 40 is integrated with the second cable 60 before being attached to the first split housing 10. In other words, after embedding the front end of the second cable 60 into the cable pressure-fixing portion 44 of the relay contact 40, the plurality of cable pressure-fixing pieces 44A of the relay contact 40 are clamped onto the front portion of the second cable 60. The cable pressure-fixing pieces 44A are thus pressure fixed (contacted) to the front end of the core wire 62 that projects (is exposed) from the front end of the covering 64, so that the relay contact 40 and the front end of the second cable 60 are integrated in a conducting state.

Next, the fixing pin 14A (FIG. 3) formed on the relay contact attachment recess 14 of the first split housing 10 is fixed into the fixing hole (not illustrated) formed on the bottom wall 41 of the relay contact 40. The relay contact 40 integrated with the second cable 60 is thereby attached to the relay contact attachment recess 14 of the first split housing 10.

Next, the middle portion of the first cable 50 is (temporarily) held by the cable pushing groove 23A of the cable pushing projection 23 of the second split housing 20.

Next, centering on the bending portion 32 of the connector 30, the first split housing 10 and the second split housing 20 are rotated to come closer together. Consequently, the middle portion of the first cable 50 is clamped between the cable pushing groove 23A of the cable pushing projection 23 of the second split housing 20 and the upper portions (V-shaped inlets) of the cable pressure-contact grooves 42A on the front and rear pair of cable pressure-contact walls 42 of the relay contact 40.

Finally, the first split housing 10 and the second split housing 20 are further rotated to come closer together from the state in which the first cable 50 is clamped between the cable pushing groove 23A and the cable pressure-contact grooves 42A. The lock piece 10*a* thus engages with the lock hole 20*a* of the lock portion 20*b*, and the lock piece 10*b* engages with the lock hole 20*c* of the lock portion 20*d*. The first split housing 10 and the second split housing 20 are thereby locked in the closed state. At this time, the covering 54 of the first cable 50 is severed by the cable pressure-contact grooves 42A. Consequently, the core wire 52 and the relay contact 40 are electrically connected.

In the above-described branch connector 1 of the present embodiment, the three U-shaped grooves 110 of the first split housing 10 (front cable holder 100) and the three U-shaped grooves 210 of the second split housing 20 (front cable holder 200) function as a "tight cable holder", on the side closer to the relay contact 40, that holds the first cable 50 so that movement in a radial direction thereof is relatively smaller when the first split housing 10 and the second split housing 20 are in the closed state. The inclined face 115 and the cable holding groove 120 (U-shaped groove 125, inclined connecting groove 130) of the first split housing 10 (front cable holder 100), together with the inclined face 215 and the pair of cable holding grooves 220 of the second split housing 20 (front cable holder 200), function as a "loose cable holder", on the side farther from the relay contact 40, that holds the first cable 50 so that movement in a radial direction thereof is relatively larger when the first split housing 10 and the second split housing 20 are in the closed state.

When, for example, the branch connector 1 is supported by the first cable 50 and the second cable 60 in a suspended state, this configuration can effectively disperse the load (a force in the bending direction) acting on the first cable 50 and the second cable 60 even upon repeated application of vibration or shock to the branch connector 1 over an extended period of time. Accordingly, breakage of the first cable 50 and the second cable 60 can be prevented.

In particular, at the bend on the lower side of the first cable 50, which is the most frequently bent portion during actual use, the first cable 50 abuts stepwise due to the inclined face 115. Hence, the stress due to bending is not concentrated (stress is dispersed) as compared to when the inclined face 115 is not formed. Accordingly, breakage of the first cable 50 can more effectively be inhibited.

In the above embodiment, the case of providing the "tight cable holder" and the "loose cable holder" only on the front cable holder 100 of the first split housing 10 and the front cable holder 200 of the second split housing 20 has been exemplified. The "tight cable holder" and the "loose cable holder" can instead be provided only on the rear cable holders 150 of the first split housing 10 and the rear cable holders 250 of the second split housing 20. Furthermore, the "tight cable holder" and the "loose cable holder" can be provided on the front cable holder 100 and the rear cable holders 150 of the first split housing 10 and also on the front cable holder 200 and the rear cable holders 250 of the second split housing 20.

In the above embodiment, a pressure-fixing relay connector that includes pressure-contact grooves for pressure contacting an existing cable and a pressure-fixing terminal for pressure fixing another cable has been exemplified. The present disclosure, however, can also be applied to a pressure-contact relay connector that includes a pair of pressure-contact grooves in parallel for pressure contacting an existing cable and another cable.

In the above embodiment, the case of only the cable holding groove 120 of the first split housing 10 having the U-shaped groove 125 that is shallower than the diameter of the first cable 50 and the inclined connecting groove 130 that connects to the inclined face 115 while increasing in diameter from the peripheral edge of the U-shaped groove 125 has been exemplified. This configuration of the cable holding groove, however, may instead be applied only to the cable holding groove of the second split housing 20 or may be applied to both the cable holding groove of the first split housing 10 and the cable holding groove of the second split housing 20.

In the above embodiment, the case of providing the elastic holder 225 on only the second split housing 20 has been exemplified, but the configuration of the elastic holder may instead be applied only to the first split housing 10 or may be applied to both the first split housing 10 and the second split housing 20.

A waterproof gel (not illustrated) surrounding the relay contact 40, the first cable 50, and the second cable 60 may be provided inside the first split housing 10 and the second split housing 20 in the branch connector 1 of the above embodiment to further improve waterproof performance.

REFERENCE SIGNS LIST

1 Branch connector
10 First split housing (pair of split housings)
10*a*, 10*b* Lock piece
11 Outer peripheral first opposing surface
12 Waterproof wall
13 Flat portion
14 Relay contact attachment recess
14A Fixing pin
20 Second split housing (pair of split housings)
20*a* Lock hole
20*b* Lock portion
20*c* Lock hole
20*d* Lock portion
21 Outer peripheral second opposing surface
22 Containing wall
23 Cable pushing projection
23A Cable pushing groove
30 Connector
32 Bending portion
40 Relay contact
41 Bottom wall
42 Cable pressure-contact wall
42A Cable pressure-contact groove
43 Extension wall
44 Cable pressure-fixing portion
44A Cable pressure-fixing piece
50 First cable
52 Core wire
54 Covering
60 Second cable
62 Core wire
64 Covering
100 Front cable holder (cable holder)
105 Half cylinder support
110 U-shaped groove (tight cable holder)
115 Inclined face (loose cable holder)

120 Cable holding groove (loose cable holder)
125 U-shaped groove (loose cable holder)
130 Inclined connecting groove (loose cable holder)
150 Rear cable holder
155 U-shaped groove
200 Front cable holder (cable holder)
205 Half cylinder support
210 U-shaped groove (tight cable holder)
215 Inclined face (loose cable holder)
220 Cable holding groove (loose cable holder)
225 Elastic holder
230 Holding arm
235 Cable mount
240 Elastic retaining projection
250 Rear cable holder
255 U-shaped groove

The invention claimed is:

1. A branch connector comprising:

a pair of split housings capable of opening and closing with respect to each other;

a relay contact supported by said pair of split housings and configured to connect electrically to a cable guided by said pair of split housings when said pair of split housings are in a closed state; and a cable holder formed in said pair of split housings and configured to hold said cable; and an elastic holder that is formed on at least one of said split housings, said elastic holder having a pair of cable mounts extending in one direction and a pair of elastic retaining projections extending in said one direction;

wherein said cable holder includes a tight cable holder, on a side closer to said relay contact, configured to hold said cable so that movement of said cable in a radial direction is relatively smaller when said pair of split housings are in said closed state and a loose cable holder, on a side farther from said relay contact, configured to hold said cable so that movement of said cable in a radial direction is relatively larger when said pair of split housings are in said closed state.

2. The branch connector of claim 1, wherein said loose cable holder includes a pair of inclined faces that are formed on said pair of split housings, are inclined relative to an opening and closing direction of said pair of split housings and relative to an extending direction of said cable, and face each other when said pair of split housings are in said closed state.

3. The branch connector of claim 2, wherein said loose cable holder includes a pair of cable holding grooves that cooperatively hold said cable when said pair of inclined faces face each other.

4. The branch connector of claim 3, wherein at least one of said cable holding grooves includes a U-shaped groove that is shallower than a diameter of said cable and an inclined connecting groove that connects to said inclined face while increasing in diameter from a peripheral edge of said U-shaped groove.

5. The branch connector of claim 1, wherein said tight cable holder includes a plurality of U-shaped grooves formed in each of said split housings at intervals in an extending direction of said cable.

6. The branch connector of claim 5, wherein said plurality of U-shaped grooves formed in one of said split housings are deeper than a diameter of said cable, and said plurality of U-shaped grooves formed in the other one of said split housings are shallower than said diameter of said cable.

7. The branch connector of claim 1, wherein the elastic holder is positioned at a front end of said loose cable holder, and elastically holds said cable so that an amount of movement of said cable in a radial direction is larger than an amount of movement of said cable in a radial direction in said loose cable holder.

* * * * *